US011226138B2

(12) United States Patent
Hofbauer et al.

(10) Patent No.: US 11,226,138 B2
(45) Date of Patent: Jan. 18, 2022

(54) THERMODYNAMIC DEVICE WITH A TENSION-COMPRESSION COIL SPRING SYSTEM

(71) Applicant: ThermoLift, Inc., Stony Brook, NY (US)

(72) Inventors: Peter Hofbauer, West Bloomfield, MI (US); YueXin Huang, Novi, MI (US); David Yates, Ann Arbor, MI (US); Sai Ronit Kaza, Ypsilanti, MI (US)

(73) Assignee: ThermoLift, Inc., Stony Brook, NY (US)

( * ) Notice: Subject to any disclaimer, the term of this patent is extended or adjusted under 35 U.S.C. 154(b) by 537 days.

(21) Appl. No.: 16/190,947

(22) Filed: Nov. 14, 2018

(65) Prior Publication Data

US 2019/0145670 A1 May 16, 2019

Related U.S. Application Data

(60) Provisional application No. 62/586,568, filed on Nov. 15, 2017.

(51) Int. Cl.
*F25B 9/14* (2006.01)
*F25B 30/02* (2006.01)

(52) U.S. Cl.
CPC ..... *F25B 9/14* (2013.01); *F25B 30/02* (2013.01); *F02G 2250/18* (2013.01)

(58) Field of Classification Search
CPC .... F25B 9/14; F25B 9/10; F25B 30/02; F25B 2309/023; F25B 2309/1428; F02G 2250/18
See application file for complete search history.

(56) References Cited

U.S. PATENT DOCUMENTS

RE30,176 E * 12/1979 Beale ..... F02G 1/0435 60/520
4,928,028 A * 5/1990 Leibovich ..... H01F 7/1646 310/23
2015/0075209 A1* 3/2015 Hofbauer ..... F25B 30/02 62/467
2016/0298878 A1* 10/2016 Hofbauer ..... F25B 30/00

* cited by examiner

*Primary Examiner* — Frantz F Jules
*Assistant Examiner* — Webeshet Mengesha
(74) *Attorney, Agent, or Firm* — Diana D. Brehob; Brehob Law, PLLC

(57) ABSTRACT

A thermodynamic apparatus that includes a displacer within a cylinder is disclosed. The displacer reciprocates within the cylinder by a linear actuator that includes electrical coils, an armature, and a coil spring system. The spring system includes collinear first and second coil springs of opposite sense. First ends of the springs are captured in a first plate; second ends of the springs are captured in a second plate. Without constraint, the springs can compensate to forces by bending, rotating, increasing in diameter, and combinations thereof. In certain applications, such as the heat pump, bending should be minimized. By selecting the points of capture of the hooks at the ends of the springs in the plates, bending force of the first spring counteracts the bending force of the second spring.

18 Claims, 4 Drawing Sheets

THERMODYNAMIC DEVICE WITH A TENSION-COMPRESSION COIL SPRING SYSTEM

FIELD OF INVENTION

The present disclosure relates to thermodynamic devices using a linear actuator that includes a tension-compression spring system.

BACKGROUND AND SUMMARY

A heat pump that has previously been disclosed in commonly-assigned U.S. application 62/562,569 uses a linear motor and one or more springs as the actuation system for the displacers. It has been found that a spring or spring system that is in compression at one end of travel and in tension at the other end of travel of the displacer results in less friction than a system in which a pair of compression springs are biased against other; such system having mutually biased coil springs is disclosed in commonly-assigned U.S. Pat. No. 9,677,794. One example of a tension-compression spring 500 is disclosed in commonly-assigned PCT/US16/51821 shown as FIG. 1. Helical grooves 502 and 504 are machined into a hollow cylinder to make spring 500. A first half of the grooves 502 have one rotational direction and a second half of the grooves 504 are in an opposite sense as the first half of the grooves. The drawing in FIG. 1 shows mounting holes 506 in a top end of spring 500 to affix spring 500 to a component. Mounting holes, which allow affixing spring 500 to a second component, in a bottom end of spring 500 are not visible in FIG. 1. Because spring 500 is symmetrical, twisting of spring 500 due to grooves 502 is substantially the same as the twisting caused by grooves 504 thereby causing the midsection 508 to twist back and forth when the spring goes between tension and compression. Tension-compression spring 500 is much more expensive and heavier than coil springs. Thus, an alternative to spring 500 is desired, particularly for mass production purposes.

When a coil spring is compressed, the spring winds up slightly. A difficulty encountered with a coil spring that is to be used in tension and compression is that both ends of the spring must be affixed to a component in the system; whereas, a spring only being used in compression is placed between two components in the system and the ends of the coil spring are free to rotate. When ends of a coil spring are constrained, which thereby presents winding and unwinding in response to compression or tension, respectively, the coil spring employs other degrees of freedom to react to changes in applied force: bending and/or growing (in compression) and shrinking (in tension) in diameter. Another spring system disclosed in Figure in PCT/US16/51821, in which an outer coil spring 510 has a first wind orientation and the inner coil spring 512 has a wind orientation that is opposite that of the first wind orientation. FIG. 2 shows the springs prior to having the smaller diameter inner coil spring 512 inserted into larger diameter outer coil spring 510. The spring ends would be captured so that the ends do not rotate when the springs are compressed or expanded.

Referring now to FIG. 3, an outer coil spring 522 shown in cross section is has a central axis 520. An inner coil spring 524 is disposed inside outer coil spring 522. The wind direction of spring 522 is opposite that of spring 524. Spring 524 is collinear with spring 524, i.e., its central axis is coincident with central axis 520 of spring 522. A gap 526 is maintained between an inner edge of outer spring 522 and an outer edge of inner spring 524 so that the windings of the springs do not rub or overlap when the springs are subject to tension or compression. A diameter 532 of outer coil 522 is greater than a diameter 534 of inner coil 524. The spring system in FIG. 3 was found to bend. In some applications such bending might be accommodated. However, in a heat pump in which the springs are part of the linear actuation system, the bending leads to the spring rubbing against adjacent components in the system. Even more troubling is that the force on the displacer is offset, i.e., not coincident with the central axis of the cylinder, causing the displacer to cock in the cylinder and increases the friction greatly. A spring system in which the springs are constrained to only grow in diameter when in compression and to only shrink in diameter when in tension is desired, particularly for a heat pump application.

To overcome at least one problem in the prior art, a thermodynamic apparatus is disclosed that has a cylinder with a central axis, a displacer adapted that reciprocates within the cylinder, a linear actuator having a linear motor which includes an armature coupled to the displacer and a spring system. The spring system includes: a first coil spring having a central axis and a second coil spring having a rotational sense opposite to that of the first coil spring. Central axes of the first and second coil springs are substantially collinear with the central axis of the cylinder. A first end of the first coil spring is captured in a first plate coupled to the displacer. A second end of the first coil spring is captured in a second plate. A first end of the second coil spring is captured in the first plate. A second end of the second coil spring is captured in the second plate. A bending direction of the first coil spring, when a force is exerted along the central axis on the first coil spring, is estimated. A bending direction of the second coil spring, when the force is exerted on the second coil spring, is estimated. Points of capture of the ends of the first and second coil springs are selected so that the bending direction of the first coil spring is diametrically opposed to the bending direction of the second coil spring with respect to the central axis.

Magnitude of the bending of the first spring is determined as a function of force exerted on the first spring along the central axis. Magnitude of the bending of the second spring is determined as a function of force exerted on the second spring along the central axis. The first and second springs are fabricated so that the magnitude of their responses to force exerted along the central axis is substantially similar.

A diameter of the first spring is greater than a diameter of the second spring such that an outer edge of the second spring is within an inner edge of the first spring. Parameters that are varied to adjust the responses of the two springs include at least one of: number of turns; material of the spring; and cross-sectional shape of the wire used to form the coil spring.

The first and second plates each have first and second orifices defined therein. Axes of the first and second orifices are parallel to the central axis. The first and second ends of the first and second springs are hooked in a manner such that the ends are parallel to the central axis. The hooks of the first ends of the first and second springs are affixed into orifices in the first plate. The hooks of the second ends of the first and second springs are affixed into orifices in the second plate.

The location of the orifices in the plates are selected so that a bend of the first spring when the first plate is displaced from the second plate by a distance is opposed by a bend of the second spring when the first plate is displaced from the second plate by the distance.

The ends of the first and second coils are affixed in their respective orifices by one of welding, brazing, swaging, friction welding, using an adhesive.

The orifices in the first and second plates have an inner portion and an outer portion. The inner portion of the orifices having a cross-section that is slightly larger than the cross section of its respective end. The outer portion flutes open such that its innermost part of the outer portion has a cross-section coincident with the inner portion and the cross-section area of the outer portion increases monotonically as considered from the innermost part of the outer portion to its outermost part. The ends of the first and second coils are welded to the inner portions of their respective orifices in the plates.

The first end of the first coil spring is arranged opposite to that of the second end of the first coil spring with respect to the centerline of the first coil spring.

The first and second ends of the first and second springs are hooked. The springs and their hooked ends when viewed axially, appear as annuluses.

The displacer is a hot displacer; the cylinder is a hot cylinder; the linear actuator is a hot linear actuator; the linear motor is a hot linear motor; and the spring system is a hot spring system, The thermodynamic apparatus further includes a cold cylinder having a central axis, a cold displacer adapted to reciprocate within the cold cylinder, a cold linear actuator having a cold linear motor which includes a cold armature coupled to the cold displacer and a cold spring system that includes: a third coil spring having a central axis and a fourth coil spring having a rotational sense opposite to that of the third coil spring. Central axes of the third and fourth coil springs are substantially collinear with the central axis of the cold cylinder. A first end of the third coil spring is captured in a third plate coupled to the cold displacer. A second end of the third coil spring is captured in a fourth plate. A first end of the fourth coil spring is captured in the third plate. A second end of the fourth coil spring is captured in the fourth plate. A bending direction of the third coil spring, when a force is exerted along the central axis of the third coil spring, is estimated. A bending direction of the fourth coil spring, when the force is exerted on the fourth coil spring, is estimated. Points of capture of the ends of the third and fourth coil springs are selected so that the bending direction of the third coil spring is diametrically opposed to the bending direction of the fourth coil spring with respect to the central axis of the cold cylinder.

Magnitude of the bending of the third spring is determined as a function of force exerted on the first coil spring along the central axis of the cold cylinder. Magnitude of the bending of the fourth spring is determined as a function of force exerted on the second spring along the central axis. Parameters of the third and fourth coil springs are selected so that the magnitude of their responses to force exerted along the central axis of the cold cylinder is substantially similar. The parameters include at least one of: a number of turns of the coil springs, material of the coils springs, heat treating of the coil springs, cross-sectional area of the coil springs, and cross-sectional shape of the coil springs.

Also disclosed is a thermodynamic apparatus that has a cylinder, a displacer disposed within the cylinder, and a linear actuation system coupled to the displacer, The linear actuation system includes: electrical coils, an armature coupled to the displacer via a shaft, a first coil spring, and a second coil spring. A first end of the first coil spring is coupled to a plate coupled to the displacer. A second end of the first coil spring is coupled to a stationary element. A first end of the second coil spring is coupled to the plate. A second end of the second coil spring is coupled to the stationary element. A bending direction of the first spring, when a force is exerted on the first spring, is estimated. A bending direction of the second spring, when a force is exerted on the second spring, is estimated. The locations of the coupling of the first and second ends of the first and second coils are selected so that the bending direction of the first spring is substantially diametrically opposed to the bending direction of the second spring.

The cylinder, the electrical coils, and the stationary element are coupled. The armature and the displacer are coupled. The coupling between the armature and the displacer is one of direct and indirect. The stationary element is a bridge across the cylinder.

A magnitude of the bending of the first spring is determined as a function of force exerted on the first coil spring along the central axis. A magnitude of the bending of the second spring is determined as a function of force exerted on the second coil spring along the central axis. The first and second coil springs are fabricated so that the magnitude of their responses to force exerted along the central axis is substantially similar.

A diameter of the first coil spring is greater than a diameter of the second coil spring such that an outer edge of the second coil spring is within an inner edge of the first coil spring. Parameters that are varied to adjust the bending responses of the two coil springs include at least one of: number of turns; material of the spring; and cross-sectional shape of the wire used to form the coil springs.

The first and second ends of the first and second coil springs are hooked. The plate has first and second orifices defined therein. The stationary element has first and second orifices defined therein. The hooks at the first ends of the first and second coil springs are affixed into orifices in the plate. The hooks at the second ends of the first and second coil springs are affixed into orifices in the stationary element.

Also disclosed is a thermodynamic apparatus that has a linear actuator. The linear actuator has first and second electrical coils, an armature, and a pair of concentrically-arranged coil springs with a common central axis. An inner of the pair of coil springs being wound in an opposite direction as the outer of the pair of coil springs. A first end of the inner coil spring and a first end of the outer coil spring are captured in a plate coupled to the armature. The plate adapted to move in a direction parallel with the central axis. A second end of the inner coil spring and a second end of the outer coil spring are captured in a stationary element.

A bending direction of the inner coil spring, when a force is exerted along the central axis on the inner spring, is determined. A bending direction of the second coil spring, when the force is exerted on the second spring, is determined. Points of capture of the ends of the first and second coil springs are selected so that the bending direction of the first spring is diametrically opposed to the bending direction of the second spring. A magnitude of a bending force of the inner coil spring is determined. A magnitude of a bending force of the outer coil spring is determined. Parameters of the inner and outer coil springs are selected so that the magnitudes of the bending forces are substantially equivalent.

Such parameters include at least one of: cross-sectional shape of the coil springs, cross-sectional area of the coil springs; number of windings of the coil springs, material of the coil springs, and manufacturing treatment.

The apparatus further includes a displacer disposed within a cylinder. The displacer is coupled to the armature via a shaft. A first of the electrical coils is proximate a first end of travel of the armature and a second of the electrical coils is proximate a second end of travel of the armature.

Advantages of disclosed embodiments include at least that the spring system in the thermodynamic is low cost, light weight, easily manufactured, and doesn't bend when the amount of tension/compression on the spring is changed.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations. Those of ordinary skill in the art may recognize similar applications or implementations whether or not explicitly described or illustrated.

Figure 1:
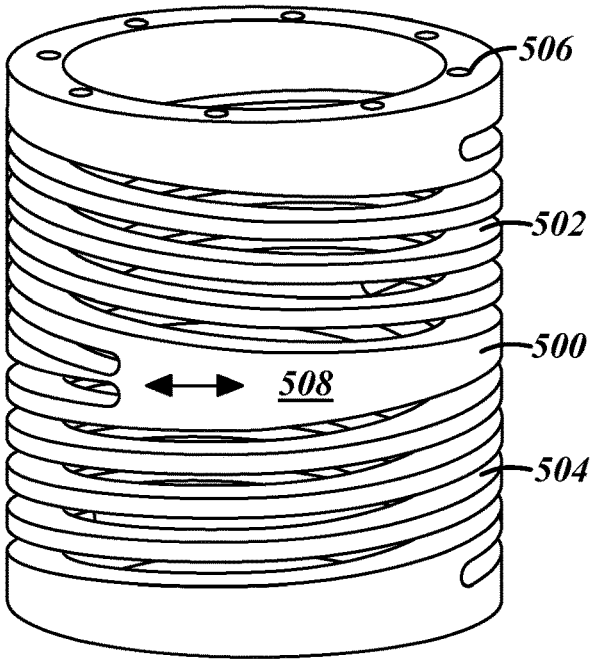
FIG. 1 illustrates a prior art tension-compression spring with first and second sets of helical grooves formed therein.
Figure 2:
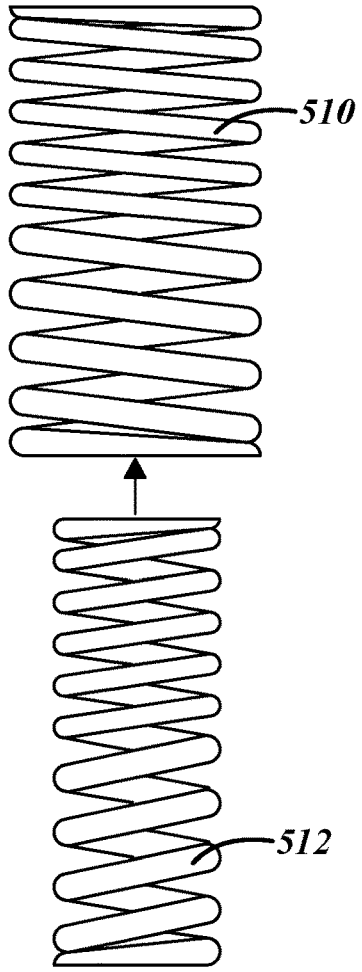
FIG. 2 illustrates a first coil spring and a second coil spring wound in the opposite direction as the first spring.
Figure 3:
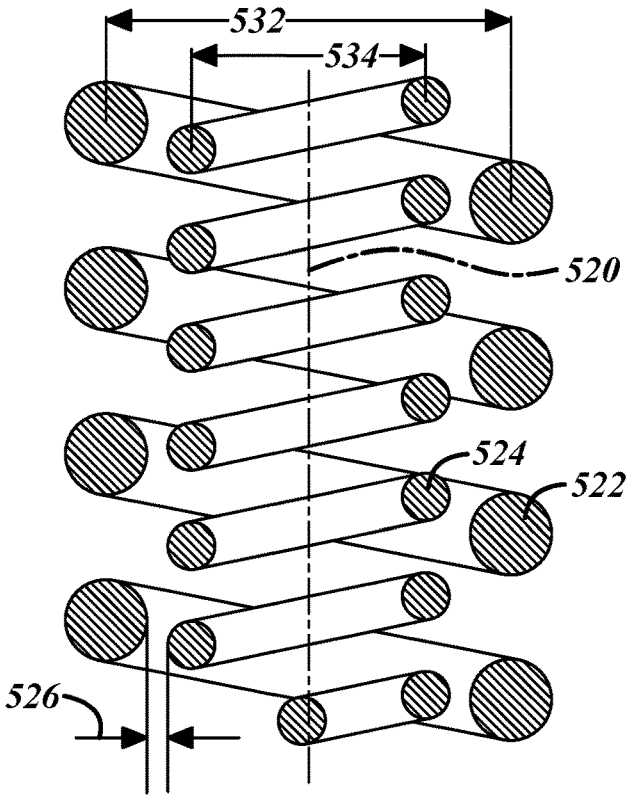
FIG. 3 illustrates first and second coil springs in cross section.
Figure 4:
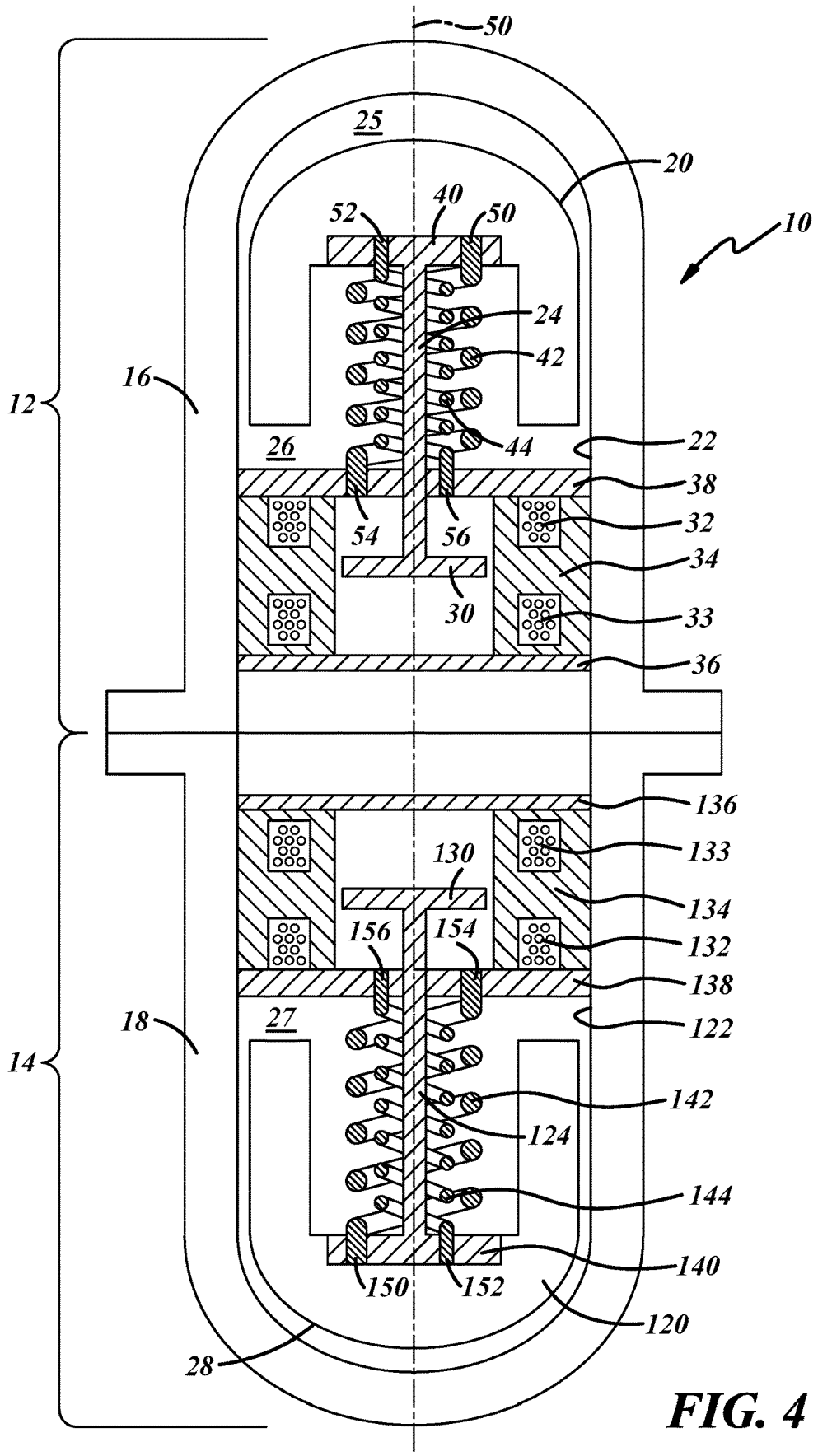
FIG. 4 illustrates an embodiment of a heat pump having pairs of coil springs acting on displacers.

In FIG. 4, a heat pump 10 is illustrated that has a hot end 12 and a cold end 14. In hot end 12, a hot displacer 20 is disposed within a hot cylinder 22. In operation displacer 20 reciprocates within cylinder 22. The position of displacer 20 controls the amount of volume inside a hot chamber 25 and the volume inside a hot-warm chamber 26. Displacer 20, as shown in FIG. 4 is in mid-stroke, thus each of chambers 25 and 26 have a considerable volume of gas therein.

Cold end 14 of heat pump 10 has a cold displacer 120 that is disposed within a cold cylinder 122. The position of displacer 120 shown in FIG. 4 is near one end of travel such that most of the volume is in cold-warm chamber 27 and very little in cold chamber 28.

In FIG. 4, hot cylinder 22 and cold cylinder 122 are collinear (along central axis 50) and have the same diameter. In alternative embodiments, the cylinders are of different diameters and offset from each other.

Hot displacer 20 has a linear actuation system that includes electrical coils 23 and 33, an armature 30, and a spring system. The armature 30 that is coupled to a shaft 24 of displacer 20. Armature 30 is acted upon by coils 32 and 33 that are surrounded by back irons 34. Movement of armature 30 is delimited by end plates 36 and 38. End plates extend across cylinder 22 and also serve as back irons. Either of electrical coils 32 or 33 can be provided a current which then exerts a force on armature 30 that causes armature 30 to move thereby moving displacer 20. The amount of current required to cause displacer 20 to move when displacer 20 is far from ends of travel is very high. Even more demanding is when displacer 20 is at one end of travel, e.g., at an upward position, meaning that armature 30 is at an upward position farthest away from coil 33, making it very challenging for coil 33 to provide attractive force to draw armature 30 downward. To help with movement, a tension-compression spring system is provided. The spring system includes an outer spring 42 that has a first wind direction (sense); and an inner spring 44 that has a second wind direction. A diameter of outer spring 42 is selected to be large enough so that inner spring 44 can be disposed within outer spring 42 and to avoid interference due to changes in the spring dimensions during reciprocation of displacer 20. Sense of outer spring 42 is opposite that of spring 44. Springs 42 and 44 are in compression when displacer 20 is close to end plate 38 and in tension when displacer 20 is far away from end plate 38, i.e., near end plate 36. To constrain the springs from rotating and pulling away, two orifices are provided in each plate 40 and end plate 38. Hooks 50 and 54 that are formed at the ends of outer spring 42 are held in place in orifices formed in plate 40 of displacer 20 and in end plate 38, respectively. Hooks 50 and 54 are affixed in the orifices so that when spring 42 is in tension hooks 50 and 54 remain in place. Hooks 50 and 54 are welded in their respective orifices in one embodiment. However, any other suitable way to affix the hooks into the orifices may be used including brazing, friction welding, using an adhesive, swaging, and by heating the element, end plate in this case, prior to inserting the hooks and/or cooling the hooks prior to insertion. Hooks 52 and 56 of inner spring 44 are coupled to plate 40 and end plate 38, analogously.

A linear actuation system is provided for cold displacer 120 that is analogous to that described for hot displacer 20. Cold displacer 120 has a shaft 124 that is coupled to an armature 130 that is acted upon by electrical coils 130 and 132, back iron 134, and end plates 136 and 138. The spring system that exerts force on displacer 120 to facilitate much of the travel from end to end includes an inner spring 144 and an outer spring 142. Hooks 150, 152, 154, and 156 of springs 142 and 144 are mounted on one end into orifices in a plate 140 coupled to displacer 120 and at the other end into orifices in an end plate 138.

Figure 5:
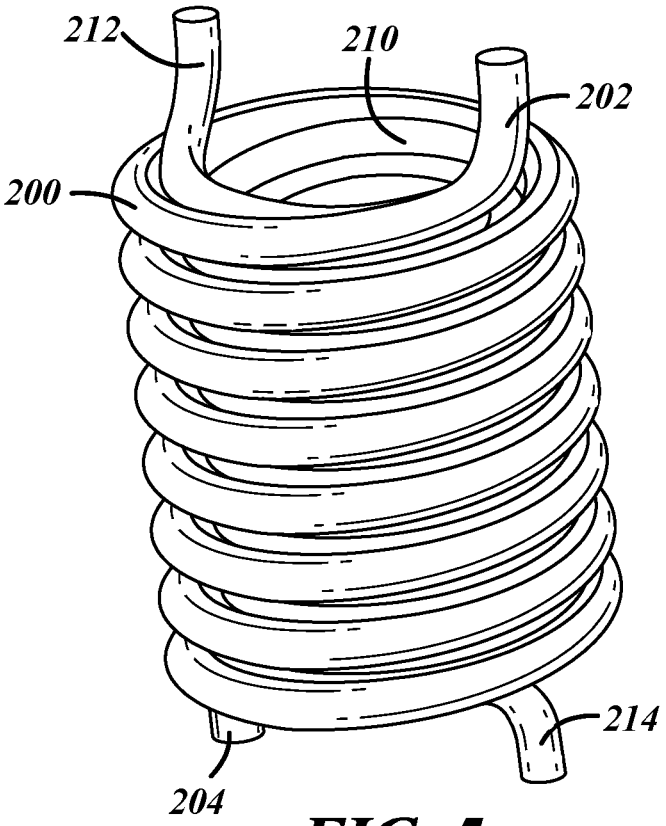
FIG. 5 illustrates a spring system having an inner coil spring and an outer coil spring each with hooks on the ends.

Referring to FIG. 5, an inner spring 200 and an outer spring 202 that has a common centerline as inner spring 200, are shown. Outer spring has a hook 202 formed at one end and a hook 204 formed at the other end. Inner spring has hooks 212 and 214 formed in the ends. A centerline of hooks 201, 204, 212, and 214 are substantially parallel to the common centerline of springs 200 and 210. In alternative embodiments, the centerline of the hooks is offset from being parallel to the common centerline of springs 200 and 210. A cross section of the wire from which springs 200 and 210 are formed is shown as circular. Alternatively, the wire can be oval, race track, polygonal, kidney bean, or any suitable shape in cross section. In other embodiments, the hooks are a different cross section than the coil portion of the spring.

Figure 6:
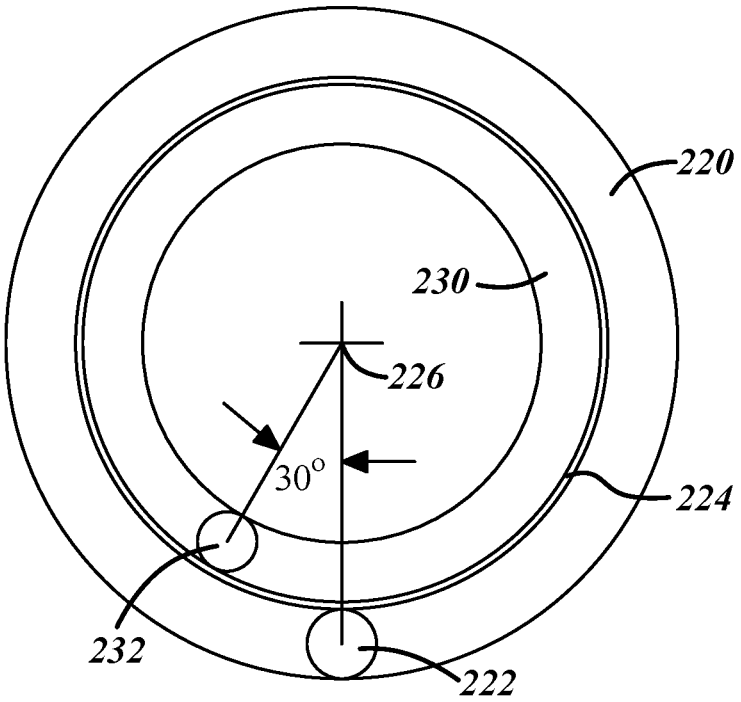
FIG. 6 illustrates a plan view of a coil spring pair.

A top view of an inner spring 220 and an outer spring 230 that have a common centerline 226 is shown in FIG. 6. There is a small gap 224 provided between springs 220 and 230 that ensures that the two springs do not interfere with or rub against each other. Outer spring 220 has a hook 222 that extends upwardly from spring 220. Hook 222 and spring 220 lie in an annulus, as viewed from the top. Similarly, a hook 232 of inner spring 230 is located within the annulus of spring 230, as viewed from the top.

Figure 7:
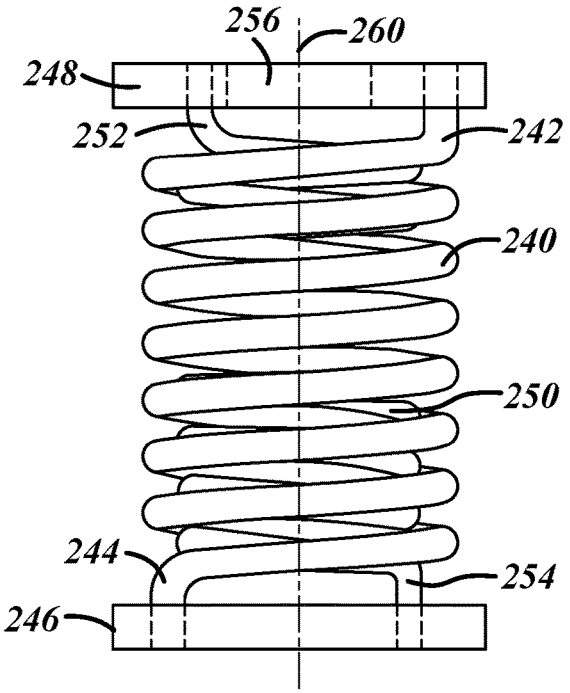
FIG. 7 illustrates a coil spring pair coupled to plates.
Figure 8:
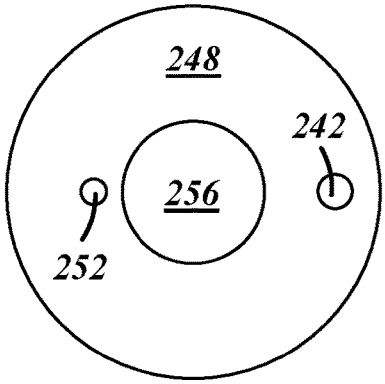
FIG. 8 illustrates a top view of one of the plates of FIG. 7.
Figure 9:
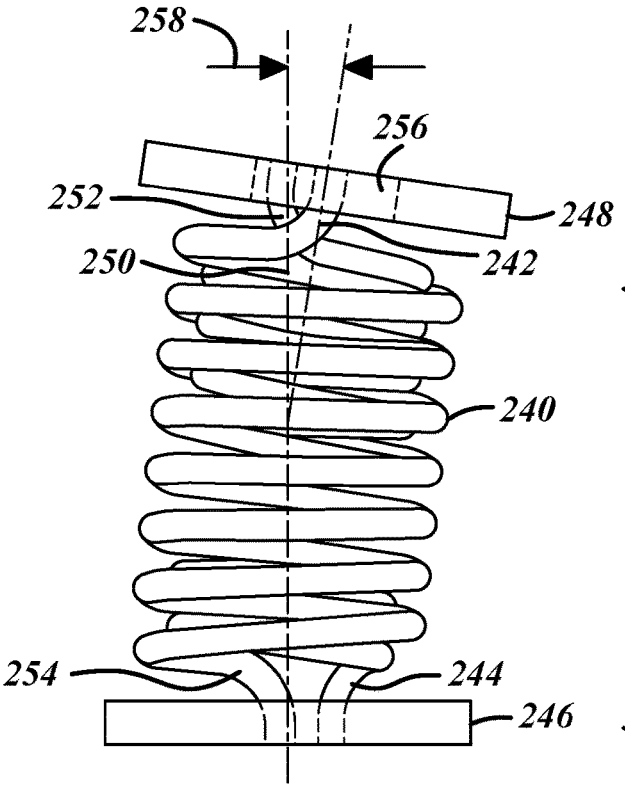
FIG. 9 illustrates the coil spring pair of FIG. 7 bending due to compression.

In FIG. 7, a spring system is shown that has an outer spring 240 and an inner spring 250 that have centerlines on axis 260. Outer spring 240 is wound with an opposite sense as that of inner spring 250. A hook 242 of outer spring 240 and a hook 252 of inner spring 250 are mounted in a plate 248. A hook 244 of outer spring 244 and a hook 254 of inner spring 250 are mounted in a plate 246. A top view of the plate system is shown in FIG. 8 that shows that plate 246 has an opening 256 defined therein that might accommodate a shaft for a displacer or other member. Hooks 252 and 254 are 180 degrees displaced from each other in plate 248. As described above, a coil spring that is constrained from rotating when being compressed, will bend. It was theorized that by arranging hooks 252 and 254 diametrically opposed to hooks 242 and 244, respectively, the bending force of coil spring 240 would largely cancel the bending force of coil spring 250. However, it has been found that by arranging hooks 242, 244, 252 and 254 as shown in FIGS. 7 and 8, the two bending forces partially reinforce each other, as shown in FIG. 9, to cause enough bending to cause operational problems in some applications. The degree of bending shown in FIG. 9 is exaggerated for illustrative purposes. The bending is about 0.5 degrees for the design of a spring system for a displacer in a heat pump that is illustrated in FIG. 9 for the displacement of the spring anticipated. If the element coupled to the spring has a, such as a far end of displacer, is 200 mm from the bending point and the bend if 0.5 degrees, the displacement of the far end is 1.8 mm. That is an unacceptable amount of side-to-side displacement for a displacer within a cylinder.

For the spring system that was evaluated, i.e., the particular sizes of coils, number of windings, material, etc., it was found that a 30-degree offset between the two coils, the bending force of the one coil almost completely counteracts the bending force of the other coil. Such an arrangement is shown in FIG. 6. It is not believed that the 30-degree offset found is universally applicable, instead depends on number of winds in each coil, coil materials, cross-sectional shape and area of the wires used to make the coil materials, heat treating, to name a non-exhaustive list. The spring system in which there are two concentric coil spring that are of opposite wind, when compressed, the inner spring wants to compensate by rotating in an opposite direction to that of the outer spring. In some applications, the plates into which hooks of the springs are captured are constrained from rotating, the spring system is further prevented from rotating when subjected to compression. According to embodiments disclosed here, bending of the coil springs is largely prevented by selecting the offset of the capture of the coils in the plates so that the desired bend direction of the inner coil is oppose that of the outer coil. Additionally, the magnitudes of the bend of the inner and outer coils are largely matched by design parameters (number of terms, characteristics of the wire from which the coil is made, etc.) Thus, the coil springs compensate in response to a force by expanding in diameter under compression and contracting in diameter under tension.

Figure 10:
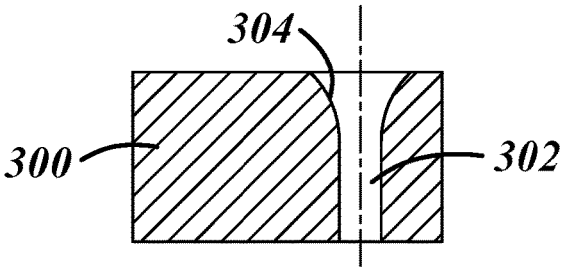
FIGS. 10 and 11 show a cross section of a portion of a plate with an orifice defined therein to accommodate a hook of a coil.
Figure 11:
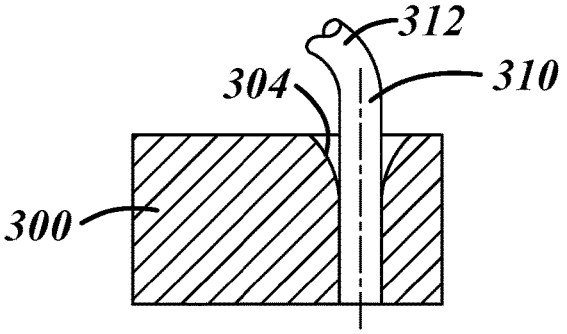

Referring to FIG. 10, a portion of a plate 300 is shown that has an orifice 302 defined therein. A chamfer 304 is provided in orifice 302 near one end. In FIG. 11, a hook 310 of a spring 312 is inserted in plate 300. A portion of hook 310 near chamfer 304 has a gap. Such an arrangement reduces stresses in hook 310. In some alternatives, no chamfer is provided, i.e., a straight orifice.

The spring system applied to a heat pump with two displacers, as illustrated in FIG. 4, is also applicable to a Stirling engine, which typically has one displacer.

While the best mode has been described in detail with respect to particular embodiments, those familiar with the art will recognize various alternative designs and embodiments within the scope of the following claims. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments described herein that are characterized as less desirable than other embodiments or prior art implementations with respect to one or more characteristics are not outside the scope of the disclosure and may be desirable for particular applications.

We claim:

1. A thermodynamic apparatus, comprising:

a cylinder having a central axis;

a displacer adapted to reciprocate within the cylinder; and a linear actuator which includes an armature coupled to the displacer and a spring system, wherein the spring system comprises:

a first coil spring having a central axis; and a second coil spring having a rotational sense opposite to that of the first coil spring, wherein:

central axes of the first and second coil springs are collinear with the central axis of the cylinder;

a first end of the first coil spring is captured in a first plate coupled to the displacer;

a second end of the first coil spring is captured in a second plate;

a first end of the second coil spring is captured in the first plate;

a second end of the second coil spring is captured in the second plate;

a bending direction of the first coil spring, when a force is exerted along the central axis on the first coil spring, is estimated;

a bending direction of the second coil spring, when the force is exerted on the second coil spring, is estimated; and points of capture of the ends of the first and second coil springs are selected so that the bending direction of the first coil spring is diametrically opposed to the bending direction of the second coil spring with respect to the central axis.

2. The thermodynamic apparatus of claim 1 wherein:

magnitude of the bending of the first coil spring is determined as a function of force exerted on the first coil spring along the central axis;

magnitude of the bending of the second coil spring is determined as a function of force exerted on the second coil spring along the central axis; and the first and second coil springs are fabricated so that the magnitude of their responses to force exerted along the central axis are equal.

3. The thermodynamic apparatus of claim 2 wherein:

a diameter of the first coil spring is greater than a diameter of the second coil spring such that an outer edge of the second coil spring is within an inner edge of the first coil spring;

parameters that are varied to adjust the responses of the first and second coil springs include at least one of: number of turns; material of the springs; and cross-sectional shape of the wire used to form the coil springs.

4. The thermodynamic apparatus of claim 1 wherein:

the first and second plates each have first and second orifices defined therein;

axes of the first and second orifices are parallel to the central axis;

the first and second ends of the first and second coil springs are hooked in a manner such that the ends are parallel to the central axis;

the hooks of the first ends of the first and second coil springs are affixed into orifices in the first plate; and the hooks of the second ends of the first and second coil springs are affixed into orifices in the second plate.

5. The thermodynamic apparatus of claim 4 wherein the location of the orifices in the plates are selected so that a bend of the first coil spring when the first plate is displaced from the second plate by a distance is opposed by a bend of the second coil spring when the first plate is displaced from the second plate by the distance.

6. The thermodynamic apparatus of claim 4 wherein the ends of the first and second coil springs are affixed in their respective orifices by one of welding, brazing, swaging, friction welding, using an adhesive.

7. The thermodynamic apparatus of claim 4 wherein:

the first end of the first coil spring is inserted into the first orifice in the first plate;

the second end of the first coil spring is inserted into the first orifice in the second plate;

the first end of the second coil spring is inserted into the second orifice in the first plate;

the second end of the second coil sprint is inserted into the second orifice in the second plate; and the ends of the first and second coil springs are welded to their respective plates.

8. The thermodynamic apparatus of claim 1 wherein: the first end of the first coil spring is arranged opposite to that of the second end of the first coil spring with respect to the center line of the first coil spring.

9. The thermodynamic apparatus of claim 1 wherein:

the first and second ends of the first and second coil springs are hooked; and the first and second coil springs and their hooked ends when viewed axially, appear as annuluses.

10. The thermodynamic apparatus of claim 1 wherein:

the displacer is a hot displacer;

the cylinder is a hot cylinder;

the linear actuator is a hot linear actuator;

the linear actuator is a hot linear actuator; and the spring system is a hot spring system, the thermodynamic apparatus further comprising:

a cold cylinder having a central axis;

a cold displacer adapted to reciprocate within the cold cylinder; and a cold linear actuator having a cold linear actuator which includes a cold armature coupled to the cold displacer and a cold spring system, wherein the cold spring system comprises:

a third coil spring having a central axis;

a fourth coil spring having a rotational sense opposite to that of the third coil spring, wherein:

central axes of the third and fourth coil springs are collinear with the central axis of the cold cylinder;

a first end of the third coil spring is captured in a third plate coupled to the cold displacer;

a second end of the third coil spring is captured in a fourth plate;

a first end of the fourth coil spring is captured in the third plate;

a second end of the fourth coil spring is captured in the fourth plate;

a bending direction of the third coil spring, when a force is exerted along the central axis of the third coil spring, is estimated;

a bending direction of the fourth coil spring, when the force is exerted on the fourth coil spring, is estimated; and points of capture of the ends of the third and fourth coil springs are selected so that the bending direction of the third coil spring is diametrically opposed to the bending direction of the fourth coil spring with respect to the central axis of the cold cylinder.

11. The thermodynamic apparatus of claim 10 wherein:

magnitude of the bending of the third coil spring is determined as a function of force exerted on the third coil spring along the central axis of the cold cylinder;

magnitude of the bending of the fourth coil spring is determined as a function of force exerted on the fourth coil spring along the central axis;

parameters of the third and fourth coil springs are selected so that the magnitude of the bending response of the third coil spring equals the bending response of the fourth coil; and the parameters include at least one of: a number of turns of the coil springs, material of the coil springs, heat treating of the coil springs, cross-sectional area of the coil springs, and cross-sectional shape of the coil springs.

12. A thermodynamic apparatus, comprising:

a cylinder having a central axis;

a displacer adapted to reciprocate within the cylinder; and a linear actuator which includes an armature coupled to the displacer and a spring system, wherein the spring system comprises:

a first coil spring having a central axis; and a second coil spring having a rotational sense opposite to that of the first coil spring, wherein:

the first coil spring has a greater inner diameter than an outer diameter of the second coil spring;

central axes of the first and second coil springs are collinear with the central axis of the cylinder;

a first end of the first coil spring and a first end of the second coil spring are captured in a first plate; and a second end of the first coil spring and a second end of the second coil spring are captured in a second plate.

13. The thermodynamic apparatus of claim 12, wherein:

a bending direction of the first coil spring, when a force is exerted along the central axis on the first coil spring, is determined;

a bending direction of the second coil spring, when the force is exerted on the second coil spring, is determined; and points of capture of the ends of the first and second coil springs are selected so that the bending direction of the first coil spring is diametrically opposed to the bending direction of the second coil spring with respect to the central axis.

14. The thermodynamic apparatus of claim 13 wherein:

magnitude of the bending of the first spring is determined as a function of force exerted on the first spring along the central axis;

magnitude of the bending of the second spring is determined as a function of force exerted on the second spring along the central axis; and the first and second springs are fabricated so that the magnitudes of their responses to force exerted along the central axis are equal.

15. The thermodynamic apparatus of claim 14 wherein parameters that are varied to adjust the responses of the two springs include at least one of: number of turns; material of the spring; and cross-sectional shape of the wire used to form the coil spring.

16. The thermodynamic apparatus of claim 12, wherein:

the first and second plates each have first and second orifices defined therein;

the first and second ends of the first and second coil springs are hooked;

the hooks of the first ends of the first and second coil springs engage with the orifices in the first plate; and the hooks of the second ends of the first and second coil springs are affixed into orifices in the second plate.

17. The thermodynamic apparatus of claim 16, wherein:

the hooks on the first and second ends of the first and second coil springs are straight with a central axis parallel to the central axis of the cylinder; and the orifices in the first and second plates are parallel to the central axis of the cylinder.

18. The thermodynamic apparatus of claim 16, wherein the location of the orifices in the plates are selected so that a bend of the first spring when the first plate is displaced from the second plate by a distance is opposed by a bend of the second spring when the first plate is displaced from the second plate by the distance.

* * * * *